US009648915B2

(12) United States Patent
Jennings

(10) Patent No.: US 9,648,915 B2
(45) Date of Patent: May 16, 2017

(54) SMART FIBRE ARMOR

(71) Applicant: James Edward Jennings, Superior, CO (US)

(72) Inventor: James Edward Jennings, Superior, CO (US)

(73) Assignee: James Edward Jennings, Superior, CO (US)

( * ) Notice: Subject to any disclaimer, the term of this patent is extended or adjusted under 35 U.S.C. 154(b) by 133 days.

(21) Appl. No.: 14/023,286

(22) Filed: Sep. 10, 2013

(65) Prior Publication Data

US 2015/0067950 A1 Mar. 12, 2015

(51) Int. Cl.

| | |
|---|---|
| ***A41D 13/05*** | (2006.01) |
| ***A42B 3/04*** | (2006.01) |
| ***A42B 3/12*** | (2006.01) |
| ***A41D 31/00*** | (2006.01) |

(52) U.S. Cl.

CPC ..... *A41D 13/0531* (2013.01); *A41D 31/0055* (2013.01); *A42B 3/046* (2013.01); *A42B 3/12* (2013.01); *A41D 2600/10* (2013.01)

(58) Field of Classification Search

CPC ..... A41D 13/1281; A41D 1/00; A41D 1/005; A41D 1/007; A41D 1/02; A41D 1/015; A41D 1/05; A41D 31/00; A41D 31/0011; A41D 31/0016; A41D 31/0044; A41D 31/005; A41D 31/0055; A41D 31/0061; A41D 31/02; A42B 3/328; A42B 3/064

USPC ..... 2/45, 456, 459–465, 467, 2.5, 425, 92

See application file for complete search history.

(56) References Cited

U.S. PATENT DOCUMENTS

| | | | | |
|---|---|---|---|---|
| 8,161,826 | B1 | 4/2012 | Taylor | |
| 8,627,512 | B2 | 1/2014 | Dodd | |
| 8,894,514 | B2 | 11/2014 | Jennings | |
| 8,961,733 | B2 | 2/2015 | Dodd | |
| 2007/0144396 | A1* | 6/2007 | Hamel | F41A 19/01 102/472 |
| 2007/0271686 | A1* | 11/2007 | Rast | A42B 3/328 2/410 |
| 2010/0101005 | A1* | 4/2010 | Cripton | A42B 3/064 2/411 |
| 2012/0091415 | A1* | 4/2012 | Sumino | H01L 43/08 257/2 |
| 2014/0353568 | A1* | 12/2014 | Boniardi | H01L 45/1293 257/4 |
| 2015/0370320 | A1* | 12/2015 | Connor | A41D 13/1281 345/173 |

* cited by examiner

*Primary Examiner* — Gloria Hale

(57) ABSTRACT

A smart fiber device is headgear, such as an athletic helmet, and includes sensing devices for detecting and deflecting impacts. The sensing devices fabric triggers the piezoelectric device so as to produce a voltage signal. A spinal protection system having a pad of energy-deflecting material that allows flexing and conform to movement. A polarizer is formed with an arrangement of polymer fibers substantially parallel within a polymer matrix. The polymer fibers may be arranged within the polymer matrix as part of a fiber weave.

1 Claim, 3 Drawing Sheets

SMART FIBRE ARMOR

CROSS REFERENCE TO RELATED APPLICATIONS

This is a Continuation of application Ser. No. 13/572,674, filed Oct. 6, 2012, now U.S. Pat. No. 8,834,303, granted Sep. 16, 2014 and application Ser. No. 13/572,679, filed Oct. 25, 2012, now U.S. Pat. No. 8,894,514, granted Nov. 25, 2014, and application Ser. No. 13/692,121 filed Dec. 3, 2012.

FIELD OF THE INVENTION

The present invention relates to a helmet and athletic wear which contains sensors together with one or more signaling devices connected to the sensors. More particularly, the sensors are adapted to respond to accelerations corresponding to, for example, impacts experienced by the wearer of the helmet and react by repercussion.

This invention further relates to protective garment padding to deflect and dissipate impacts. More particularly, this invention relates to a system for protecting a spine of a user. Still more particularly, this invention relates to a spinal protection system that is flexible to allow a user to move with minimal restriction and is breathable to allow perspiration to escape from the body of a user.

BACKGROUND OF THE INVENTION

Because of fiberglass's light weight and durability, it is often used in protective equipment, such as helmets. Many sports use fiberglass protective gear, such as modern goaltender masks and newer baseball catcher's masks. Fiberglass is a lightweight, extremely strong, and robust material. Although strength properties are somewhat lower than carbon fiber and it is less stiff, the material is typically far less brittle, and the raw materials are much less expensive. Its bulk strength and weight properties are also very favorable when compared to metals, and it can be easily formed using molding processes.

One-two and three-dimensional space charge distributions in glass fiber/epoxy resin composites. By the conventional pulsed electroacoustic (PEA) method, only a one-dimensional distribution of the average charge over a whole area parallel to the two electrodes can be observed. Therefore, the authors have developed a new PEA system capable of measuring a three-dimensional space charge distribution. Using this system, they measured the charge distribution in glass fiber/epoxy resin composites made of lattice-woven glass fiber and epoxy resin. It has become clear that spatial variation in signal intensity observed depends on the internal structure of the composite. There appear repetitious positions where a high charge density is observed on the same lateral cross section along the vertical direction in the composite. Such positions are consistent with the intersections of the glass fibers. Accumulation of mobile charge carriers or appearance of polarization charge due to mismatch of the ratio of the conductivity and permit activity between the glass fiber and the epoxy resin is thought to be responsible for the PEA signals.

Unfortunately, there is the possibility of serious physical injury in sports such as football. Particularly serious are neck injuries which could be prevented by the present invention. The invention limits the movement in any direction of the head and neck during impact and thus prevents serious injuries. Abrupt and extended movements of the head are the cause of many injuries.

Statement of the Problem

Many sports and occupations require safety equipment such as padding that protects the users from impacts that occur. Some examples of sports where padding is needed include but are not limited to bicycling, football, hockey, in-line skating, skiing and snowboarding. An example of an occupation that requires safety equipment is construction. Designers of such safety equipment face a number of obstacles.

One particular area of concern for designers of safety equipment is the head and spine. A spinal protector must provide acceptable protection for the spine. The spinal protector should also be flexible to allow a user to flex and bend in a natural manner with minimal impedance. A spinal protector should also be lightweight in order to not overburden the user. Furthermore, a spinal protector should also be breathable to allow perspiration and heat to escape from the body of the user. Although there are a number of spinal protection systems in the art, heretofore prior art spinal protectors do not adequately satisfy these requirements.

SUMMARY OF THE INVENTION

This invention relates to a protective head gear and in particular to a new and piezoelectric football helmet. The said helmet and garment and/or pads are constructed out of a smart fiber. The Smart Sensor polymer fiber has either a glass like or foam outer shell and/or woven finish as Fiberglass. A more specific object to this invention is to provide a new and improved helmet design which includes an outer malleable helmet portion suspended from an inner smart fabric weave helmet portion by resilient means and a pad assembly which is coupled to the helmet to limit the movement thereof and not limited to the application of shoulder, spinal, leg pads garments to distribute impact. Concussion occurs by hard on hard contact, rocking the brain to an opposite surface. Our invention promotes a semi resilient initial contact that protrudes, deflects and dissipates by smart fiber sensor.

Statement of the Solution

The above problems are solved in an advance, in the art is made by headgear 36 and spinal and lower body protection system of this invention. This spinal protection system is flexible in that the system allows a user to bend with minimal hindrance. The protection system in accordance with this invention also braces the back to prevent the spine from being bent over backwards in an undesirable direction. A spinal protection system 39 in accordance with this invention also allows perspiration to escape. Therefore, a disposed spinal protection system is in a garment 14.

In this invention, a spinal protection system is configured in the following manner. The spinal protection system has a pad of flexible, energy-absorbing material that receives and dissipates energy of an impact. The pad has an inner side that is proximate a back of a user, an outer side opposite said inner side, a first side perpendicular to a longitudinal axis and a second side perpendicular to the longitudinal axis. The longitudinal axis is substantially parallel to a spine of a user.

In a preferred embodiment, when pressure is applied to a sensor 99, for example when it is touched, a conductive channel is formed. If the pressure is light the conductive fibers 10 in the central layer will only just make sufficient contact to open up a continuous channel and the resistance of the channel will be high. Conversely, when a high force is applied to a sensor 99 many more of the conductive fibers 10 in the central layer will be brought into close proximity and thus the resistance in the channel will be relatively low. The variable resistance in the channel is, therefore, dependant on the pressure applied. To determine the Z axis force the electronic controller supplies a current to the upper and lower conductive layers 11 which in the resting state presents an open circuit 200 and no current flows between the outer layers 11. When the sensor 99 is touched and the pressure increases, a conductive channel of increasing resistance deforms 13 the circuit 200 whereupon the resulting current flow is high and related to the pressure applied.

In a secondary embodiment, the spinal protection system of this invention is inserted into a pocket of a garment 14 on a dorsal side designed to receive the pad 15. The inner side of the pad is proximate an outer layer 11 of the garment 14 and the outer side is proximate the inner side of an outer layer of the pocket. The inner side of the pad 15 may be to the inner side of the pocket or outer side of the garment 14. The pad 15 may be removable from the pocket.

DETAILED DESCRIPTION

The spinal protection system of this invention is for use in garments for protection in sporting events and occupational wear. Smart materials are designed materials that have one or more properties that can be significantly changed in a controlled fashion by external stimuli, such as stress, temperature, moisture, pH, electric or magnetic fields. Smart fiber headgear and garments deform 13 protrude out upon impact to hard state. This vents from an at rest weave 19 to a deformation 13 by electricity. Piezoelectric 44 fabric charges by impact, vibration, heat and movement. Helmet is the smart device.

This product is a textile based sensor technology that provides the basis for a soft, flexible, and lightweight interface between users and electronic devices. This unique fabric structure can accurately sense location on three axes—X, Y and to a certain degree Z—within a material that is less than 1 mm thick. Therefore not only senses where it is being touched (the X and Y axes), but also how hard it is pressed, the Z axis.

Charged Resin 20 and/or a closed cell polyethylene foam outer shell of textiles comprising two conductive outer layers separated by a partially conductive central layer. The outer layers each have two conductive-fabric 12 electrode strips arranged so that the upper conductive layer has tracks which make contact across its opposing top and bottom edges and the lower conductive layer has conductive tracks up its left and right sides. Layers and/or a weave of characteristic threads/fibers.

Its role is to act as an insulator in the resting state which, when touched, allows electrical current to flow between the top and bottom layer. Pressure applied to the fabric 12 causes two effects. First, the conducting fibers 10 in the central layer 11 are locally compressed allowing contact between neighboring conducting fibers to form a conductive channel through the central layer. Second, the applied pressure brings the two outer layers into contact with the conductive channel running through the central layer allowing a local circuit 200 is between the upper and lower layers.

X, Y sensing: The conductive outer layers are constructed using moderately resistive components so that when a voltage is applied across the sheet, via the electrodes, there is a distinct voltage drop across the conductive sheet. When the voltage is measured at points across the lower sheet, it acts like the track of a potentiometer allowing the x-position to be calculated from the voltage which can be measured, when the sensor is pressed, via the top sheet. The y-position is made by applying a voltage to the top sheet and measuring on the lower sheet. These measurements can be made up to 1000 times a second providing, in effect, continuous X, Y positional data.

Z-axis pressure sensing: When pressure is applied to A sensor 99, for example when it is touched, a conductive channel is formed. If the pressure is light the conductive fibers 10 in the central layer will only just make sufficient contact to open up a continuous channel and the resistance of the channel will be high. Conversely, when a high force is applied to A sensor many more of the conductive fibers in the central layer will be brought into close proximity and thus the resistance in the channel will be relatively low. The variable resistance in the channel is, therefore, dependant on the pressure applied. To determine the Z axis force the electronic controller supplies a current to the upper and lower conductive layers which in the resting state presents an open circuit and no current flows between the outer layers. When the sensor is touched and the pressure increases, a conductive channel of decreasing resistance forms the circuit whereupon the resulting current flow is high and related to the pressure applied.

The fibers 10 may also be laid on the first layer 100, 150 as part of one or more weaves. A weave 10 is schematically illustrated in FIG. 1A-1B, FIGS. 2-3 in which the polymer fibers 10 form the warp and cross-fibers 10 form the weft. The cross-fibers 10 may be made of any suitable fiber material, organic or inorganic, and may be, for example, polymer fibers, such as isotropic and/or birefringent polymer fibers, or natural fibers, such as cotton, silk and hemp. In other exemplary embodiments, the cross fibers 10 may be glass fibers, for example E-glass or S-glass fibers, glass-ceramic fibers or ceramic fibers as discussed above. The refractive index of the cross-fibers 10 may be substantially matched to that of the surrounding polymer matrix so that the cross-fibers have a reduced optical effect on light passing within the polarizer. In addition, not all of the warp fibers need be polymer fibers containing birefringent interfaces. Polarizer 55 can also be made for other types of electromagnetic waves besides light, such as radio waves, microwaves, and X-rays.

FIG. 1 shows a Phase Change Material 17 embodiment of the flexible composite constructed by laminating layers of different materials together. Layer A is a layer of closed cell neoprene foam that acts as thermal insulation. Layer B includes an inner web of perforated neoprene foam. The webbing serves as the matrix which contains the PCM 17 and lends structure to the composite. The PCM 17 is preferably in pelletized form so that the rigidity of the PCM in its solid form does not adversely affect the flexibility of the composite. Layer C is a thin layer of closed cell neoprene foam. Layers A, B, and C are bonded together to make the composite material and/or wove into a single layer 17.

FURTHER DETAIL

Piezoelectric materials are materials that produce a voltage when stress is applied. Since this effect also applies in the reverse manner, a voltage across the sample will produce stress within the sample. Suitably designed structures made from these materials can therefore be made that bend, expand or contract when a voltage is applied. Shape-memory alloys and shape-memory polymers are materials in which large deformation can be induced and recovered through temperature changes or stress changes (pseudoelasticity). The large deformation 13 results due to martensitic phase change.

Chromogenic systems change color in response to electrical, optical or thermal changes. These include electrochromic materials, which change their color or opacity on the application of a voltage (e.g., liquid crystal displays), thermochromic materials change in color depending on their temperature, and photochromic materials, which change color in response to light—for example, light sensitive sunglasses that darken when exposed to bright sunlight.

Dielectric elastomers (DEs) are smart material systems which produce large strains (up to 300%) under the influence of an external electric field. Magnetocaloric materials are compounds that undergo a reversible change in temperature upon exposure to a changing magnetic field. Thermoelectric materials are used to build devices that convert temperature differences into electricity and vice-versa.

Electrochromic polymers have been around for a while, but they were too small and fragile to be practical, make them long and flexible enough to be woven 19 into cloth for color changes. For a display or touchscreen, making the fibers useful for color-changing fabrics, is to control the fibers on the scale of a single pixel. Threads 34 with different charges could be woven together with thin metal wires designed to deliver various voltages, with the intersection between a thread and a wire serving as a pixel. Change the voltage 18 by an embed battery results in different colors.

Battery 41 power is via kinetic energy 35. Energy 35 is recollected while thru movement. This garment uses piezoelectric material and creates a voltage when it is deformed 13 like bent or twisted. An integrated rectifier 36 circuit 100, 150, 200, 300 connects the strips to capacitors 92 which store electrical 37 charge and feed the electrical 37 power to the batteries 41.

DESCRIPTIONS OF DRAWINGS

FIG. 1A-B illustrates a fiber weave used in a deformation Phase Change Material composite.

ALTERNATE EMBODIMENTS

Figure 1A:
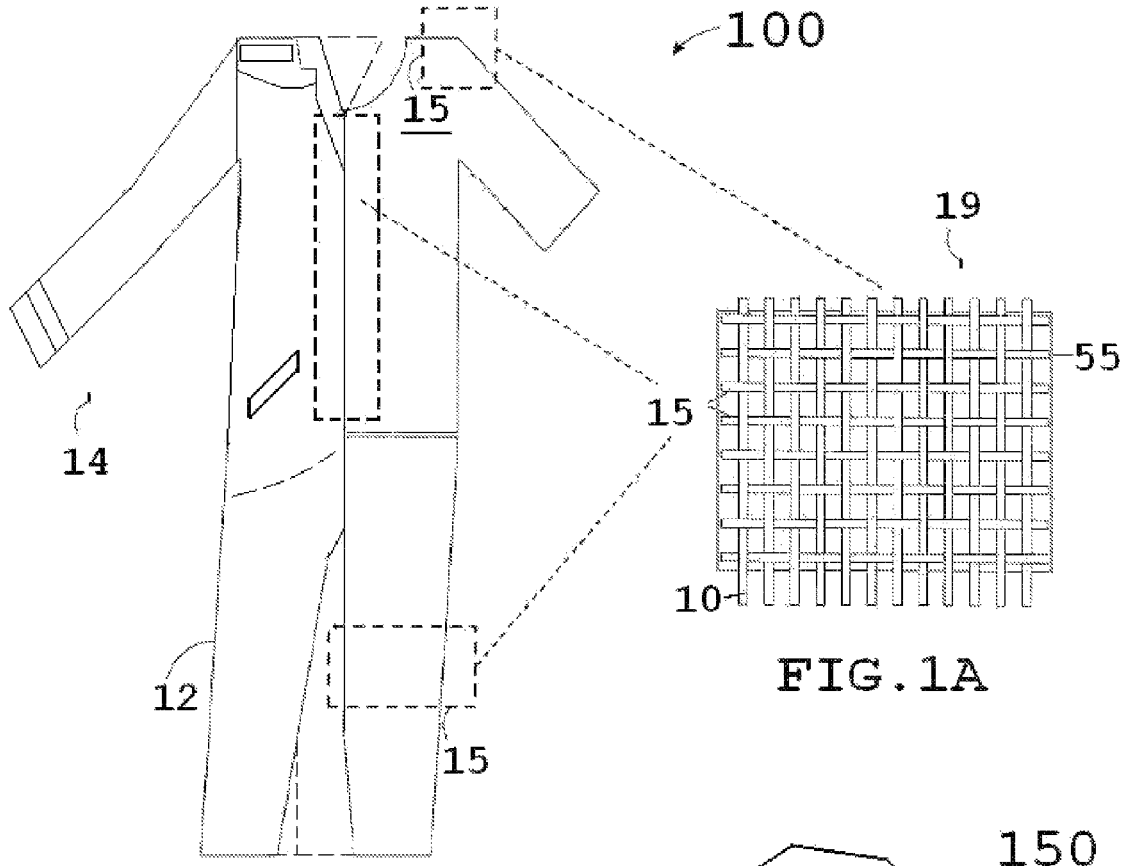
Figure 1B:
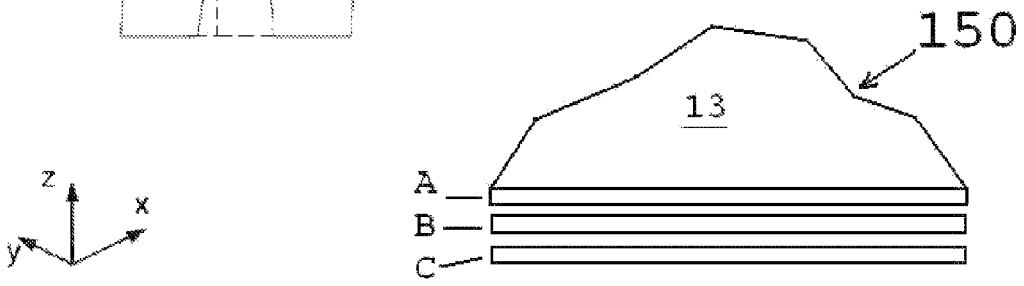
Figure 2:
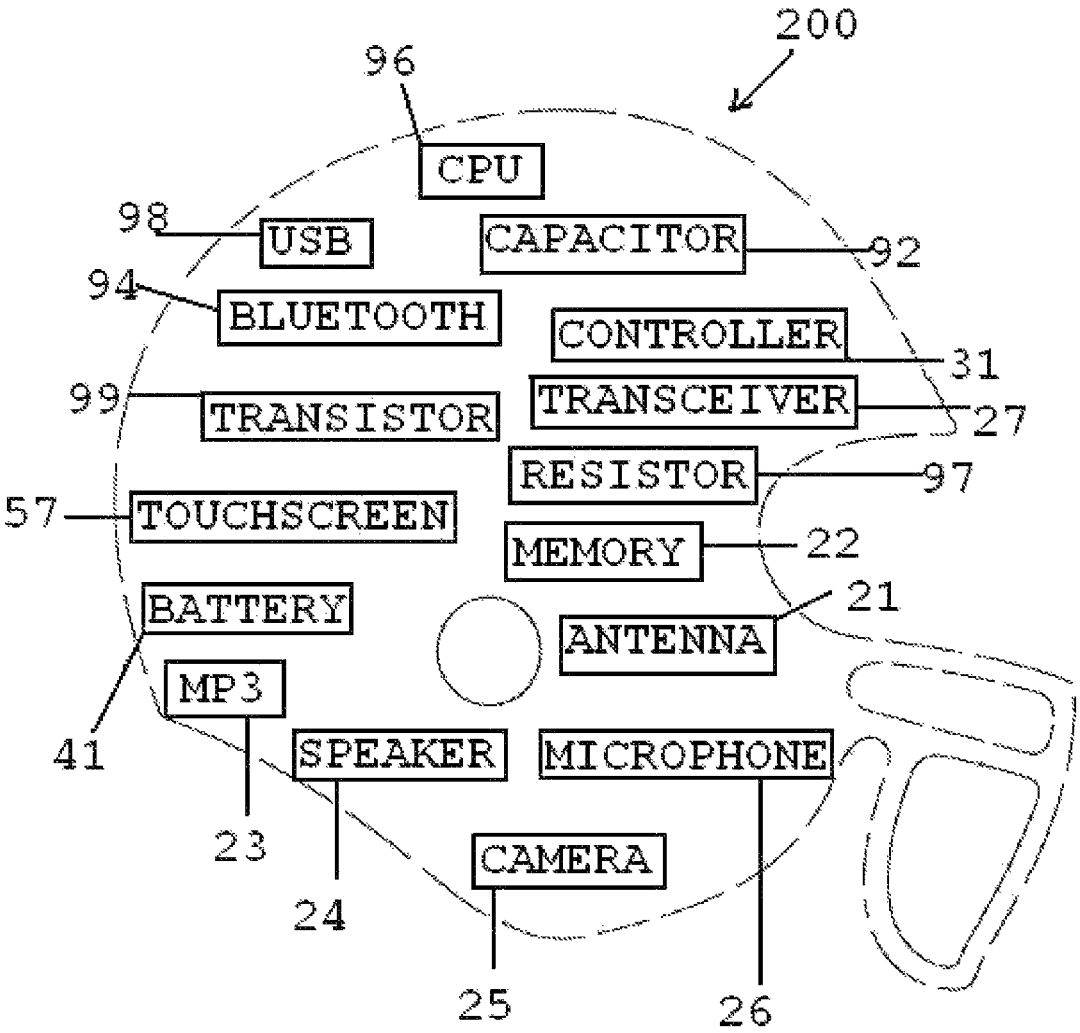
FIG. 2 is a side view of the improved athletic helmet schematic circuit.
Figure 3:
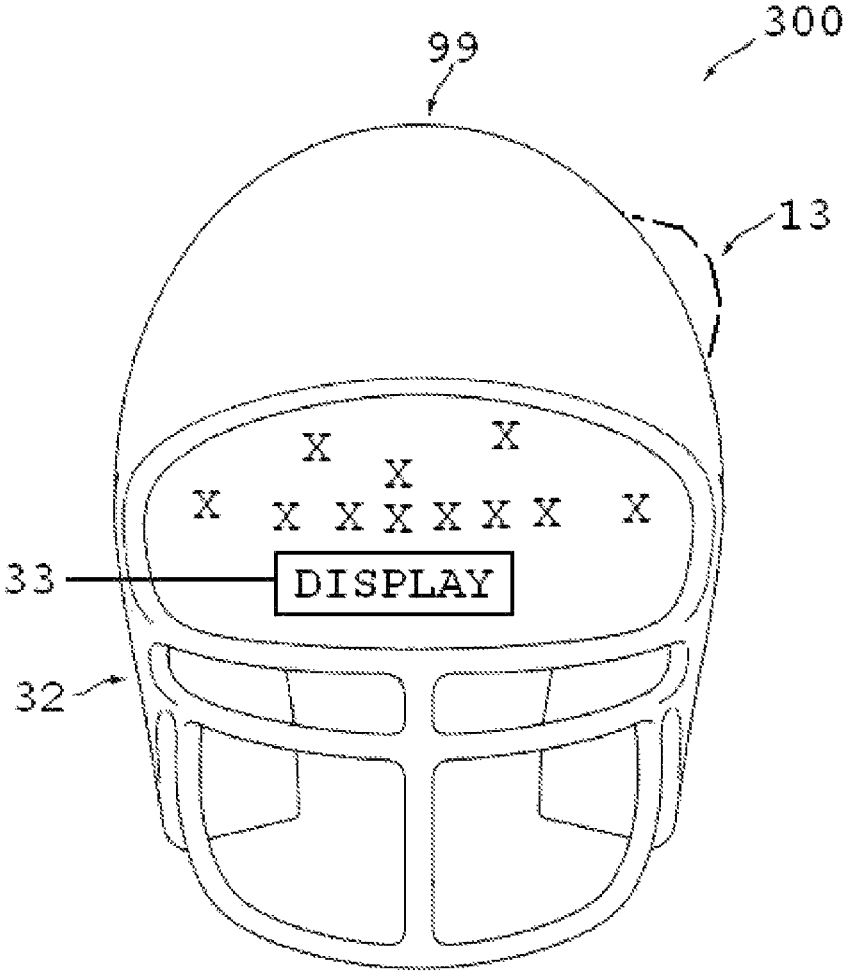
FIG. 3 is a front view of the improved athletic helmet and eyeshield display.

Shape memory polymers 45 can retain two or sometimes three shapes, and the transition between those is induced by temperature. In addition to temperature change, the shape change of SMPs can also be triggered by an electric or magnetic field, light or solution. As well as polymers in general, SMPs 45 also cover a wide property-range from stable to biodegradable, from soft to hard, and from elastic to rigid, depending on the structural units that constitute the SMP. SMPs include thermoplastic and thermoset (covalently cross-linked) polymeric materials. SMPs are known to be able to store up to three different shapes in memory. SMPs have demonstrated recoverable strains of above 800%. Helmet 200,300 materials may include Kevlar, Nano technology, titanium nickel, nitinol, fiber optic matrix and components such as air bags, shock absorbers, micro sensors 99, touchscreen 57, eyeshield 54 display 33 screens, mp3s 23, CPU, memory 22, antenna 21, speaker 24, camera 25, microphone 26, transceiver 27, controller 31, battery 41, capacitor 92, bluetooth 94, CPU 96, resistor 97, USB 98 and face guard 32.

I claim:

1. A smart fiber armor system comprising: an athletic wear garment formed of composite material including three dimensional space charge distributions in said material composites for a piezoelectric electroacoustic impact shell dissipation, energy absorption and nano-electronic communication;

an apparel helmet formed of a crumple outer panel or shell that absorbs impact for an alert of pads, shock struts and sensor layers that deform signaling impacts to thereby reduce cumulative concuss collisions;

said helmet including an eye windshield force touchscreen for information data management and capacity communication;

a smart haptic defense sensor with a g-force tracking for a physiological metrics transformation;

an apparel electronic circuit with an impact response sensor pad apparatuses on said helmet garment that wirelessly notify a smart transceiver device for an alert of head-body contact deformation;

a kinetic capacitating apparel including a fashion controller for receiving dissipating energy by a deformation upon impact of axis X, Y and Z with force on said apparel wherein said apparel provided is a phase shape change material that is formed by laminating neoprene foam layers A, B and C with a nano electronic circuit lattice;

a 3D nano-antenna mega-surface cloak for covering shapes and rerouting reflected light waves; a plus dimensional grid with an organic absorption and three dimensional material for a change; a 3D force sensor touchscreen smart device including a nano-electronic circuit for a display: a stealth shell material including a camera, CPU, and sensors for an electrochromic body; an organic light sensitive display including nano electronics for a conductive haptic response; a fiber glass slate with a matrix-strip for a photovoltaic thermoelectric photogenic charge; and a matrix glass 3D haptic-screen including a piezoelectric polymer polarizer and nano-electronics in said apparel garment material.

* * * * *